US007597596B2

(12) United States Patent
Watanabe

(10) Patent No.: US 7,597,596 B2
(45) Date of Patent: Oct. 6, 2009

(54) CRIMPING TERMINAL WITH PROJECTION AT BOTTOM OF INSERTION HOLE

(75) Inventor: Jin Watanabe, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/320,273

(22) Filed: Jan. 22, 2009

(65) Prior Publication Data

US 2009/0191771 A1 Jul. 30, 2009

(30) Foreign Application Priority Data

Jan. 24, 2008 (JP) ..... 2008-014130

(51) Int. Cl.
*H01R 4/10* (2006.01)

(52) U.S. Cl. ..... 439/877

(58) Field of Classification Search ..... 439/877, 439/878, 879, 882, 805, 784; 29/854
See application file for complete search history.

(56) References Cited

U.S. PATENT DOCUMENTS 5,899,777 A * 5/1999 Liang ..... 439/805
6,071,155 A * 6/2000 Liang ..... 439/805
6,676,458 B2 * 1/2004 Kuwayama et al. ..... 439/877
6,857,895 B2 * 2/2005 Korte et al. ..... 439/428
6,951,491 B2 * 10/2005 Sakaguchi et al. ..... 439/879
6,976,889 B2 * 12/2005 Kuwayama et al. ..... 439/877
7,121,872 B1 * 10/2006 Hanks ..... 439/427
7,174,633 B2 * 2/2007 Onuma ..... 29/854

FOREIGN PATENT DOCUMENTS

| | | |
|---|---|---|
| JP | 2003-168502 | 6/2003 |
| JP | 2003-243058 | 8/2003 |
| JP | 2003-249281 | 9/2003 |
| JP | 2003-249284 | 9/2003 |
| JP | 2003-317817 | 11/2003 |
| JP | 2004-014216 | 1/2004 |

* cited by examiner

*Primary Examiner*—Chandrika Prasad
(74) *Attorney, Agent, or Firm*—Edwards Angell Palmer & Dodge LLP

(57) ABSTRACT

The present invention is to provide a crimping terminal. The crimping terminal includes a crimping part, an insertion hole having a bottom provided in the crimping part and projections provided on an inner bottom surface of the insertion hole. When the aluminum electric wire is inserted into the insertion hole, the conductor of aluminum electric wire is relatively rotated against the crimping terminal. As a result, an oxide layer formed on a surface of the conductor is efficiently removed by the projections formed on the inner bottom surface. In low electric resistance condition, the crimping terminal connects with the conductor of the aluminum electric wire.

4 Claims, 3 Drawing Sheets

CRIMPING TERMINAL WITH PROJECTION AT BOTTOM OF INSERTION HOLE

The priority application Number Japan Patent Application No. 2008-014130 upon which this patent application is based is hereby incorporated by reference.

BACKGROUND OF THE INVENTION

1. Field of the Invention

The present invention relates to a crimping terminal, particularly to a crimping terminal which can suitably connect with an aluminum or aluminum alloy electric wire.

2. Description of the Related Art

In the conventional wiring harness arranged in a vehicle such as a motor vehicle, generally copper electric wires are used as a conductor. The copper wires are made of copper material having superior electrical conductivity, and manufactured at low cost. An aluminum electric wire (including an aluminum alloy electric wire) is not used often as a conductor since characteristic of conductive property and intensity is less than the copper wire. However, in recent years, automotive lightening is desired so as to achieve low fuel consumption from strong request against environmental issues. Also, wishes regarding use of an aluminum electric wire are increasing in the automotive industry.

Meanwhile, density of an aluminum electric wire (density of aluminum is 2.7 g/cm$^3$) is about one third lighter than a conventional useful copper electric wire (density of copper is 8.96 g/cm$^3$). However, mechanical strength of aluminum is low. In addition, the surface of conductor of aluminum is susceptible to oxidation. As a result, oxidized aluminum, that is, oxide layer is formed on the surface. The oxide layer is a very thin layer, but has an insulation property. Thereby, when the aluminum electric wire in which the oxide layer was formed is connected, there is a problem such that electric resistance becomes high. For this reason, it is required to remove the oxide layer from the surface of aluminum electric wire when the aluminum electric wire is connected. Especially, in case of aluminum electric wire for operating at a low voltage such as a signal wire, removal of the oxide layer is important so as to conduct electricity certainly.

A crimping terminal is known as a connecting terminal for connecting an aluminum electric wire to a non-terminating portion of a vehicle. The crimping terminal has a locking portion and a crimping part. The locking portion is connected to the non-terminating portion and formed in one end of the crimping terminal. The crimping part is connected to the aluminum electric wire and formed in another end of the crimping terminal. This kind of the crimping terminal for using an aluminum electric wire has a U-shaped crimping part in which a slanting serration is formed on the inside. When the aluminum electric wire is crimped, the oxide layer formed on the surface of conductor is destroyed by the serration and connected (for example, see the patent document 1: Japan published patent application 2003-249284). Also, an electric wire connecting terminal described in the patent document 2 is known. The electric wire connecting terminal of the patent document 2 (Japan published patent application 2004-14216) has an insertion hole, a terminal of male screw side, and a terminal of female screw side. An aluminum electric wire is inserted into the inset hole. In the terminal of male screw side, the male screw is formed on an outer circumference. In the terminal of female screw side, the female screw for screwing the male screw is formed. By rubbing the conductor against the screw formed in an inner wall of the insertion hole and screwing the screw, the oxide layer is destroyed. Thereby, the electric wire is connected.

The crimping terminal for aluminum electric wire disclosed in the patent document 1 mounts a conductor of aluminum electric wire on the crimping part formed in a U-shaped, bends an end portion of thereof, and then is crimped to the conductor. Thereby, when the exposed conductor is long, a part thereof protrudes from the crimping terminal for aluminum electric wire easily. Additionally, the part may come into contact with nearby other components.

On the other hand, in the electric wire connecting terminal described in the patent document 2, a conductor of aluminum electric wire is inserted into the insertion hole, and then is crimped and fixed. Thereby, a part of the conductor little protrudes from the electric wire connecting terminal. However, components are large, and shape of components is complex. As a result, it causes increase in cost by additions of components. Furthermore, there is room for improvement.

In addition, the crimping terminals of both the patent documents 1 and 2 have not processing function of the oxide layer (specifically, dust of the oxide layer) removed from the conductor. As a result, the dust of oxide layer goes in between the conductor and the crimping surface of the crimping terminal. Thereby, electric resistance may become high.

SUMMARY OF THE INVENTION

An object of the present invention is to provide an inexpensive and simple crimping terminal, in particular a crimping terminal which can securely remove a coating having insulation properties of the oxide layer formed in a conductor of aluminum wire, and can be connected to an electric wire in condition that electric resistance is low.

The above described object is achieved in the following construction.

(1) A crimping terminal includes a crimping part, an insertion hole having a bottom provided in the crimping part, and projections provided on an inner bottom surface of the insertion hole. The crimping part is crimped onto a conductor at a tip of an electric wire inserted in the insertion hole so as to electrically connect with the electric wire, and the conductor abuts against the inner bottom surface of the insertion hole, which surface forms a deepest portion of the insertion hole.

(2) With the construction described above, when the electric wire is rotated around the longitudinal axis thereof on condition that a surface of the tip of the conductor abuts on the inner bottom surface, the projections remove an insulating coat covered in the surface of the tip of the conductor.

(3) Preferably, the projections are arranged at the inner bottom surface in spirals (4) Preferably, the electric wire is an aluminum electric wire having an aluminum conductor or an aluminum alloy electric wire having an aluminum alloy conductor.

According to the above construction, the projections are arranged on the inner bottom surface of the insertion hole. The inner bottom surface is formed on a deepest portion of the insertion hole, and the conductor of the electric wire abuts thereon. Thereby, when the electric wire is inserted into the insertion hole, in condition that the conductor at the tip of an electric wire abuts on the inner bottom surface, the electric wire is relatively rotated against the crimping terminal or moved up-and-down. As a result, a surface of the conductor is removed by the projections. For example, even if an insulating coating such as an oxide layer is formed on the surface of the conductor of the aluminum electric wire, the insulating coating can be removed from the conductor efficiently. Therefore, the electric wire and the crimping terminal can be connected in condition that electric resistance is low.

According to the above construction, when the electric wire is rotated around the longitudinal axis thereof on condition that the surface of the tip of the conductor abuts on the inner bottom surface, preferably an insulating coat covered in the surface of the tip of the conductor is removed by the projections. That is to say, the insulating coat can be removed from the conductor efficiently by screwing the electric wire and inserting it into the insertion hole. Therefore, the surface of the conductor can be chipped with the projections simply by inserting an aluminum electric wire into the insertion hole. Furthermore, the electric wire and the crimping terminal can be connected securely in condition that electric resistance is low.

With the construction described above, the projections are arranged on the inner bottom surface of the insertion hole in spirals. Thereby, when the crimping terminal is relatively rotated by the electric wire which is screwed and inserted into the insertion hole, a dust of the insulating coat removed from the electric wire by the projections moves outward of a radial direction of the inner bottom surface. As a result, the dust of oxide layer is effectively removed from a contact portion between the conductor and the crimping terminal. Therefore, the electric wire can be securely connected in low electric resistance without influence from the dust of the insulating coat. Also, according to combination of the construction described above, an effect removing the dust of the oxide layer is increased.

With the construction described above, the electric wire is an aluminum electric wire having an aluminum conductor or an aluminum alloy electric wire having an aluminum alloy conductor. Thereby, the insulating oxide layer which is formed on the surface of the conductor and made of oxidized aluminum can be removed, and the electric wire can be connected. Therefore, a conventional copper electric wire can be changed to an aluminum electric wire or an aluminum alloy electric wire. Furthermore, a wiring harness arranged in a vehicle can be reduced in weight and increase fuel consumption.

EFFECT OF THE INVENTION

According to the present invention, an inexpensive and simple crimping terminal can be provided. The crimping terminal can remove a coating having insulation properties of an oxide layer formed in a conductor of aluminum wire. Furthermore, the crimping terminal can be connected in condition that electric resistance is low.

As described above, the present invention is briefly explained. Moreover, the present invention is more clearly understood by reading preferred embodiments below.

The above and other objects and features of this invention will become more apparent from the following description taken in conjunction with the accompanying drawings.

DESCRIPTION OF THE PREFERRED EMBODIMENT

Hereinafter, preferred embodiments of crimping terminal of the present invention will be described with reference to the drawings.

Figure 1:
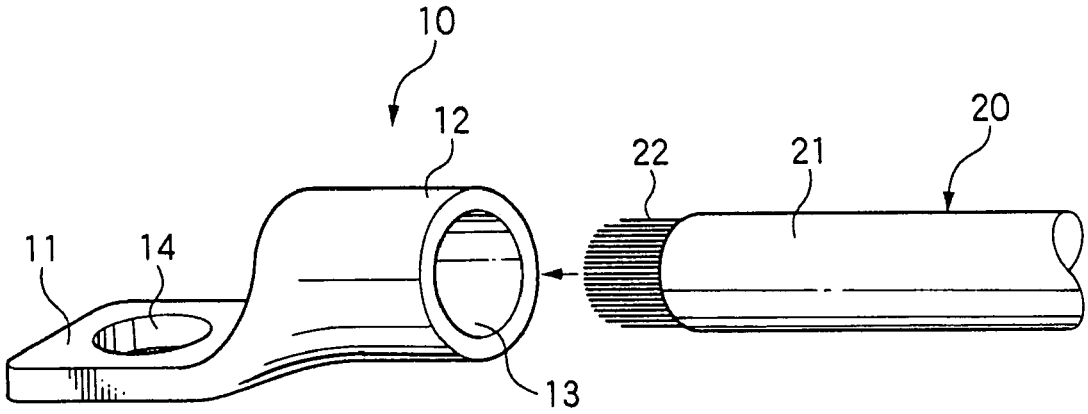
FIG. 1 is a perspective view of a crimping terminal according to the present invention.
Figure 2:
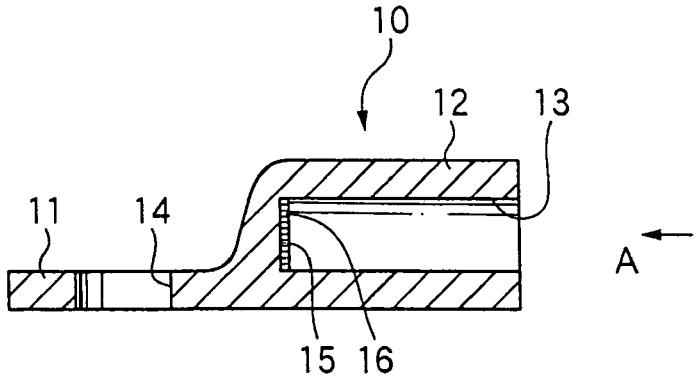
FIG. 2 is a longitudinal cross-sectional view of the crimping terminal in FIG. 1.

As shown in FIGS. 1 and 2, a crimping terminal 10 of the present invention is integrally molded by casting metallic material such as aluminum, an aluminum alloy, copper, a copper alloy, brass and so on or by processing a sheet metal. In the crimping terminal 10, one end thereof is arranged at a flat-shaped connecting portion 11. The connecting portion 11 is previously formed by pressing, and is connected to a non-terminating portion (not shown) of electric apparatus. In another end, a cylindrically-shaped crimping part 12 is arranged. In the crimping part 12, an insertion hole 13 is formed so as to insert a conductor 22 of a tip of an aluminum electric wire 20. The insertion hole 13 has a bottom. A depth of the insertion hole 13 is equal to a length of the conductor 22.

In the flat-shaped connecting portion 11, a through hole 14 is arranged. The through hole 14 can insert a bolt (not shown) and so on. For example, by inserting the bolt into the through hole 14 and fastening the bolt to the non-terminating portion of the electric apparatus, the crimping terminal 10 is connected to the electric apparatus and conducts electricity. The conductor 22 of the aluminum electric wire 20 is inserted into the insertion hole 13, and is compressed from the outside of the crimping part 12 and fixed. As a result, the crimping terminal 10 is electrically connected to the conductor 22 of the aluminum electric wire 20.

Figure 3:
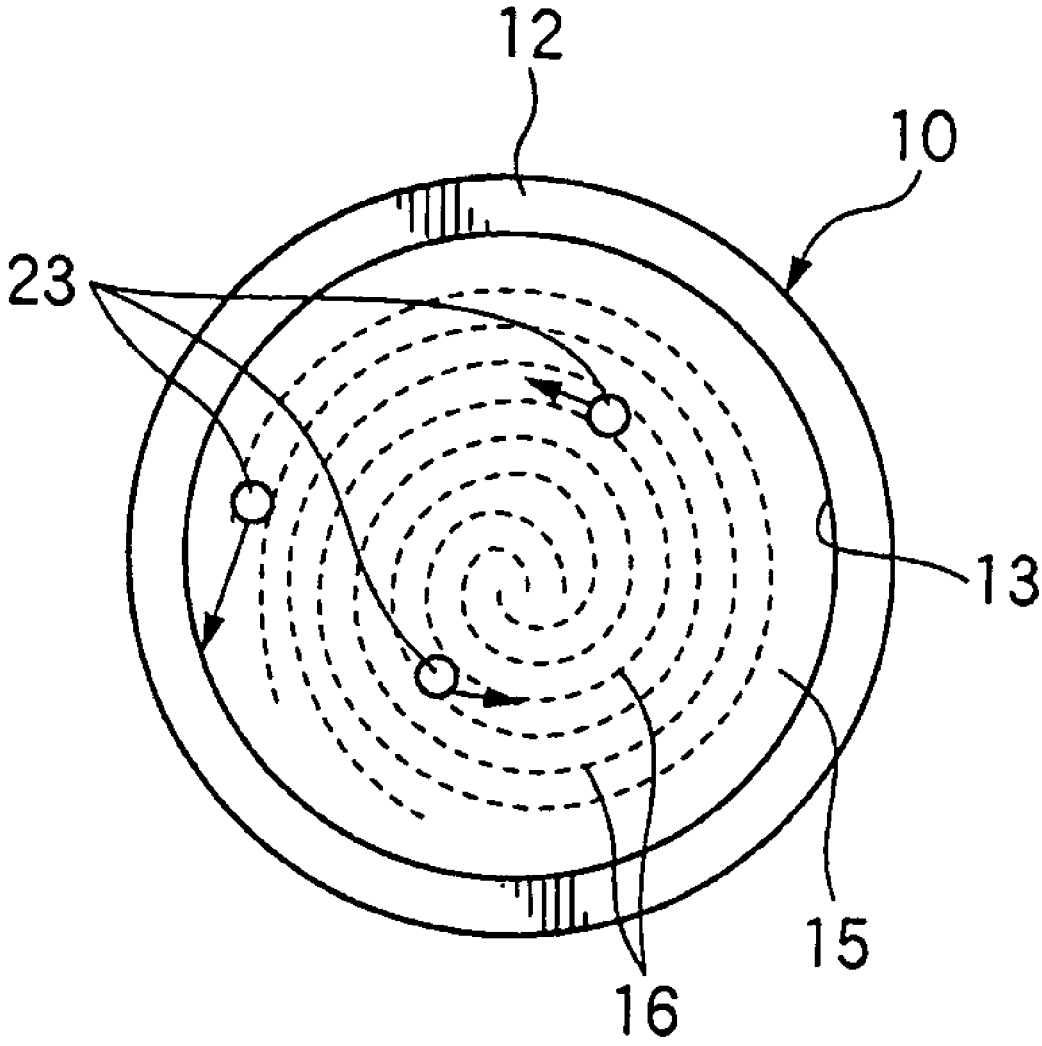
FIG. 3 is a drawing viewed from arrow A in the crimping terminal shown in FIG. 2; and, FIGS. 4A, 4B and 4C are a cross-sectional view showing a process attaching and connecting the aluminum electric wire 20 to the crimping terminal 10.

The insertion hole 13 is a pouched hole, and includes an inner bottom surface 15. In the surface of the inner bottom surface 15, a deepest portion with which the conductor 22 of the aluminum electric wire 20 comes into contact is formed. As shown in FIG. 3, a plurality of projections 16 is arranged in spirals. A tip of the projection 16 is formed in a tapered shape. Preferably, the plurality of the projections 16 are formed with materials having hardness higher than an oxide layer so as to scrape off the oxide layer of the aluminum electric wire 20 from the aluminum electric wire 20.

As shown in FIG. 1, the aluminum electric wire 20 has the conductor 22 made of aluminum or aluminum alloy. The conductor 22 made of aluminum or aluminum alloy is formed in a plurality of aluminum wires or aluminum alloy wires. An outer circumference of the conductor 22 is covered an outer covering 21 made of insulating resin such as vinyl chloride so that the whole conductor 22 is surrounded with the outer covering 21.

Next, process connecting the aluminum electric wire 20 to the crimping terminal 10 described above will be explained as below.

Figure 4A:
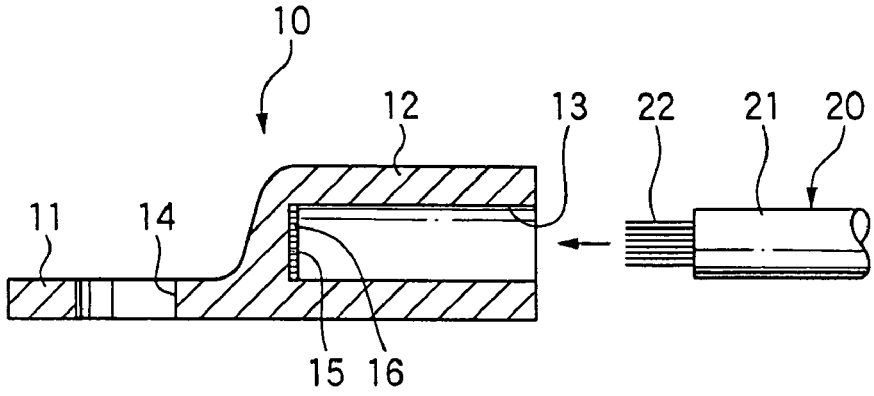

As shown in FIG. 4A, the outer covering 21 of one end of the aluminum electric wire 20 is removed in predetermined length and exposed. The exposed tip of the conductor 22 is inserted into the insertion hole 13 of the crimping terminal 10. The inserted tip of the conductor 22 abuts on the plurality of the projections 16 formed in the inner bottom surface 15 of the insertion hole 13.

Figure 4B:
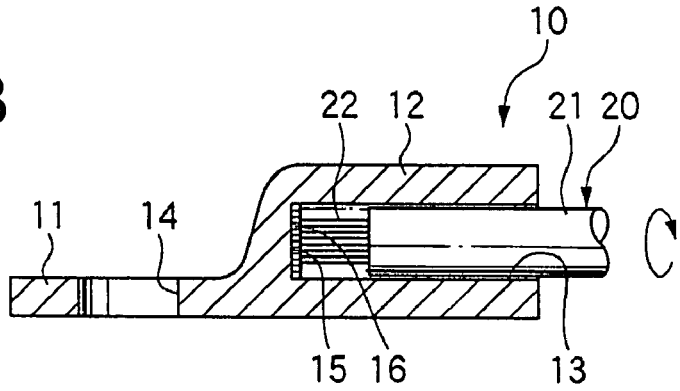

And then, as shown in FIG. 4B, in condition pressing the aluminum electric wire 20 into the plurality of the projections 16, the aluminum electric wire 20 is rotated around the axis of longitudinal direction. That is, by screwing the aluminum electric wire 20 and inserting it into the insertion hole 13, the crimping terminal 10 and the aluminum electric wire 20 rotate relatively. Thereby, the tip of the conductor 22 is rubbed off with the plurality of the projections 16, and the oxide layer (oxidized aluminum) formed in the conductor 22 is scraped off. As a result, a fresh base metal of aluminum which is not oxidized is exposed, and comes into contact with the crimping terminal 10 in condition that electric resistance is low.

Meanwhile, as shown in FIG. 3, dust of the oxide layer 23 (hereafter, dust 23) which is scraped off by the projections 16 moves outward of a radial direction according to a row of the projections 16 arranged in spirals with relative rotation of the aluminum electric wire 20. Thereafter, the dust 23 is removed to the outmost circumference of the inner bottom surface 15 of the insertion hole 13. Therefore, the dust 23 being insulator is prevented from getting into a contact portion between the aluminum electric wire 20 (the conductor 22) and the crimping terminal 10. Additionally, low electric resistance is held, and the aluminum electric wire 20 is electrically connected to the crimping terminal 10.

The projections 16 shown in FIG. 3 are formed with a left spiral type. Thereby, preferably the aluminum electric wire 20 is pressed into the projections 16 with rotating the aluminum electric wire 20 to a left direction relatively. The projections 16 may be formed with a right spiral type. In this case, the aluminum electric wire 20 is pressed into the projections 16 with rotating the aluminum electric wire 20 to a right direction relatively. Thereby, the dust 23 is removed to the outmost circumference of the insertion hole 13.

Figure 4C:
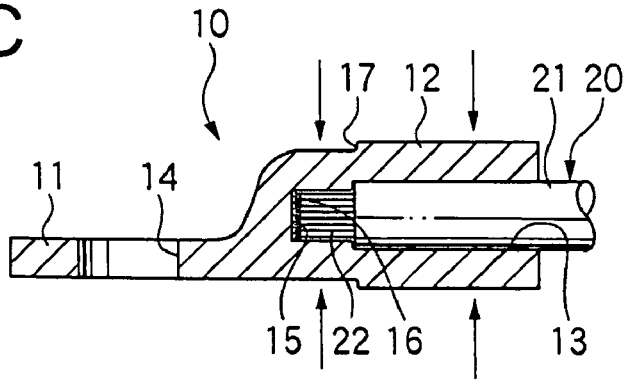

As shown in FIG. 4C, the aluminum electric wire 20 (the conductor 22) is further pressed into the inner bottom surface 15 of the insertion hole 13. And then, the crimping part 12 is pressed from the outside by a crimping jig (not shown). Thereafter, the conductor 22 and the outer covering 21 are fixed by crimping each other. As a result, a dent 17 is formed on an outer surface of the crimping part 12. Thereby, the conductor 22 and the outer covering 21 are securely fixed each other. Additionally, the aluminum electric wire 20 does not come off the crimping terminal 10 easily.

On the other hand, the conductor 22 extends to a longitudinal direction of the aluminum electric wire 20 by pressed from the outside. Furthermore, a tip of the conductor 22 is pressed into the projections 16, is stuck thereon and connected to the projections 16. Thereby, the aluminum electric wire 20 is securely and electrically connected in condition that electric resistance is low.

As described above, according to the present invention, the plurality of the projections 16 is arranged on the inner bottom surface 15 of the insertion hole 13, which comes in contact with the conductor 22 of the aluminum electric wire 20 and forms the deepest portion. Thereby, the conductor 22 of the aluminum electric wire 20 rotates relatively against terminal 10 by shaking and inserting the aluminum electric wire 20 into the insertion hole 13. As a result, the oxide layer formed on the surface of the conductor 22 is efficiently removed by the projections 16. That is, by only shaking and inserting the aluminum electric wire 20 into the insertion hole 13, the surface of the conductor 22 can be removed by the projections 16. Furthermore, the aluminum electric wire 20 and the crimping terminal 10 are connected in condition that electric resistance is low.

Also, the projections 16 are spirally arranged on the inner bottom surface 15 of the insertion hole 13 and formed. Thereby, when the crimping terminal 10 is relatively rotated by the aluminum electric wire 20 shaken and inserted, the insulating dust 23, which abuts against the projections 16 and is removed from the aluminum electric wire 20, moves outward of a radial direction of the inner bottom surface 15. Therefore, the aluminum electric wire 20 can be securely connected in condition of low electric resistance without influence of the dust 23 having insulation performance.

Herewith, the copper electric wires used in a wiring harness arranged in a vehicle such as a motor vehicle, in which weather resistance (for example, high temperature and humidity, bending and tension) is required, can be changed into the aluminum wires. Additionally, by using the aluminum wire in the vehicle, it is possible to reduce weight of the vehicle and to improve fuel cost.

For example, when a space between an outer periphery surface of the aluminum electric wire 20 and an inner periphery surface of the insertion hole 13 is larger than a certain size, the oxide layer of the aluminum electric wire 20 can be scraped off by moving the conductor 22 of the aluminum electric wire 20 up and down. However, when the plurality of the projections 16 is arranged in spirals, it is preferable that the aluminum electric wire 20 is rotated around a longitudinal axis thereof. In this case, the dust 23 of the oxide layer moves effectively toward the outside of a radial direction of the inner bottom surface 15 of the insertion hole 13. Therefore, the aluminum electric wire 20 can be more securely connected in condition that electric resistance is lower. In this preferred embodiment, the plurality of projections 16 is arranged on the inner bottom surface 15 of the insertion hole 13. However, instead, in the present invention, the projections 16 may be one projection if the object of the present invention can achieve. In this case, it seems that one linear projection formed in a projected shape is provided in a bent condition (including a spiral form). Moreover, in the above embodiment, the crimping terminal 10 is explained as the crimping terminal 10 in which the connecting portion is formed in one end but not limited thereto. It is possible to apply a crimping terminal in which the connecting portion is not arranged such as a crimping part of a transit connection terminal of electric wires. Also, not only the aluminum electric wire but also various electric wires such as copper electric wires can be applied.

The above described embodiments are only exemplary but not limited thereto. Any modifications and alterations thereof are within the scope of the present invention.

What is claimed is:

1. A crimping terminal comprising:

a crimping part;

an insertion hole having a bottom provided in the crimping part; and projections provided on an inner bottom surface of the insertion hole;

wherein the crimping part is crimped onto a conductor at a tip of an electric wire inserted in the insertion hole so as to electrically connect with the electric wire, wherein the conductor abuts against the inner bottom surface of the insertion hole, which surface forms a deepest portion of the insertion hole.

2. The crimping terminal as claimed in claim 1, wherein when the electric wire is rotated around the longitudinal axis thereof on condition that a surface of the tip of the conductor abuts on the inner bottom surface, the projections remove an insulating coat covered in the surface of the tip of the conductor.

3. The crimping terminal as claimed in claim 1, wherein the projections are arranged on the inner bottom surface in spirals.

4. The crimping terminal as claimed in claim 1, wherein the electric wire is an aluminum electric wire having an aluminum conductor or an aluminum alloy electric wire having an aluminum alloy conductor.

* * * * *